US007661292B2

(12) United States Patent
Buitmann et al.

(10) Patent No.: US 7,661,292 B2
(45) Date of Patent: Feb. 16, 2010

(54) DEVICE AND METHOD FOR DETECTION OF COLLISIONS IN FURNITURE

(75) Inventors: Michael Buitmann, Gersten (DE); Michael Köder, Plochingen (DE); Thomas Strothmann, Bramsche (DE)

(73) Assignee: Kesselbohmer Produktions GmbH + Co., KG, Weilheim/Teck (DE)

( * ) Notice: Subject to any disclaimer, the term of this patent is extended or adjusted under 35 U.S.C. 154(b) by 280 days.

(21) Appl. No.: 11/843,905

(22) Filed: Aug. 23, 2007

(65) Prior Publication Data

US 2008/0289544 A1 Nov. 27, 2008

(30) Foreign Application Priority Data

Aug. 24, 2006 (EP) ..... 06017650

(51) Int. Cl.
*G01M 7/00* (2006.01)

(52) U.S. Cl. ..... 73/12.01; 73/760

(58) Field of Classification Search ..... 73/760–860, 73/12.01–12.09

See application file for complete search history.

(56) References Cited

U.S. PATENT DOCUMENTS 4,912,727 A * 3/1990 Schubert ..... 312/334.8
5,322,257 A * 6/1994 Verderose et al. ..... 248/345.1
5,857,415 A * 1/1999 Richard ..... 108/50.01
6,246,576 B1 * 6/2001 Sands et al. ..... 361/679.02
2006/0266791 A1 11/2006 Koch et al.

FOREIGN PATENT DOCUMENTS

AT 501 146 A4 7/2006
DE 19956009 6/2001

* cited by examiner

*Primary Examiner*—Max Noori
(74) *Attorney, Agent, or Firm*—Butzel Long

(57) ABSTRACT

This invention relates to a device and a method for recognizing collision of automatically moveable parts of furniture with obstacles by detecting a change in bend or a change in acceleration. This is carried out by a device for recognizing collisions of automatically moveable parts of furniture with obstacles, comprising a piece of furniture with at least one moveable part (1, 2, 31), wherein this part is a adapted to be moved relatively to the rest of the furniture in a non-manual manner, an automatic driving mechanism adapted to move the moveable part, a controller adapted to control the automatic driving mechanism, and a sensor (4) adapted to detect a collision with an obstacle during the movement of the moveable part and to transmit the collision to the controller, wherein the sensor is adapted to detect a change in bend or a change in acceleration of the moveable part.

20 Claims, 6 Drawing Sheets

DEVICE AND METHOD FOR DETECTION OF COLLISIONS IN FURNITURE

The invention relates to a device and a method for detecting collisions of furniture, and relates in particular to a device and a method for detecting collisions of automatically moveable parts of furniture with obstacles by detecting a change in bend or a change in acceleration.

From the prior art, furniture comprising automatically moveable parts are known, e.g. desks comprising table tops, which are automatically adjustable in height, or filing cabinets, book cases, wardrobes or cupboards with automatically actuated doors. In this, "automatically moveable" describes the state, that a possible movement of parts of furniture is driven in a non-manual way, e.g. by a spring mechanism, a hydraulic or pneumatic mechanism, or a motor driven gear. Such a desk shown in FIG. 1, comprises, besides a table top 1, a supporting framing 2, two table legs 3 being adjustable in length in a telescopic way and being connected with the supporting framing. The table legs include e.g. an electric motor and a threaded spindle (not shown) for an automatic adjustment in length. When operating a not shown switch by an operator, the electric motors are driven by a not shown controller, the threaded spindles rotate and the table legs are elongated or shortened in a telescopic manner depending on the direction of rotation. The controller stops the electric motors, if the operator releases the switch, operates the switch again or operates another switch, or if maximum or minimum extending positions of the table legs are reached. Since such a table top is designed to carry relatively high loads, like several CRT monitors, or numerous books/files, the mechanics and the electric motors are designed accordingly powerful. This leads to the appliance of relatively high forces during an automatic adjustment in height of the table top. Other mechanisms are usable for a drive of a movement, like differently implemented electric driven gears or a hydraulic or pneumatic mechanism. In the scope of the invention, also devices, e.g. projectors, monitors or the like, which are automatically retractable into the desk, are regarded as parts of furniture.

Adjustments in height of the table top may lead to damaging the desk and third objects or even persons, which are arranged above or below the table top, if there occur collisions of the table top and the object while adjusting the height. To prevent this, collision detection devices are employed which detect a collision of the table top with an obstacle by one or more sensors and signal the collision to the controller which subsequently stops the operation of the electric motors. Conventionally, mini safety edges are used as sensors. These mini safety edges are attached in pre-defined regions, usually along the outer edges of the table top, and transmit a signal to the controller, when a pressure is applied to them in a distinct scope of direction. These mini safety edges have the problem that they are expensive, especially due to their wide area application along all edges of the table top. Further, a collision is only detected if it occurs at the mini safety edge, i.e. in the region of the table top's edges, and if this involves applying pressure to the mini safety edge from a restricted scope of directions. If a collision only occurs some distance within the table top, it can not be detected by the mini safety edge. Further, the wide area application of the mini safety edges restricts the scope for aesthetic design of the table top.

The invention is based on the object to provide a method and a device for detecting collisions of automatically moveable parts of furniture with obstacles, the method and device eliminating the named draw-backs, and especially providing a device and a method to duly, securely and cost efficiently detect a collision of the moveable part with an obstacle across the whole area of the moveable part.

This object is solved by a device according to claims 1 and 13 and by a method according to claim 16.

Further advantageous developments are subject-matter of the dependent sub-claims.

As already mentioned, a device, e.g. projectors, monitors or the like, which are automatically retractable into the desk are regarded as moveable parts of furniture in the scope of the invention.

The invention provides a device for detecting collisions of automatically moveable parts of furniture with obstacles comprising: an item of furniture having at least one moveable part, wherein this part is adapted to be moved relatively to the rest of the item of the furniture, an automatic driving mechanism adapted to move the moveable part, a controller adapted to control the automatic driving mechanism, and a sensor adapted to detect a collision with an obstacle during a movement of the moveable part and to signal it to the controller. At this, the sensor detects a change in bend of the moveable part.

The device can be provided cost efficiently, if the sensor is a piezoelectric sensor, especially, if the sensor is a piezoelectric diaphragm for generating acoustic signals.

The reliability of the detection of collisions can be augmented by that the sensor is attached at the moveable part at an attachment location to which a high bending moment is applied in a case of a collision. Such attachment locations preferably are located at a radial inner side of a hollow table leg, on the table top in immediate proximity to the upper end of the table leg, and on a horizontal supporting plate of a supporting framing of the table top connected with a table leg.

To integrate the device in already existing desk solutions without amending them, it is advantageous, if an additional plate is provided at the upper end of the table leg and the attachment location is arranged on the additional plate. In that, the additional plate may exceed the perimeter of the table leg and the attachment location may be arranged outside of the outer circumference of the upper end of the table leg, which is advantageous, if the circumference of the table leg is too small to accommodate the sensor.

Further, the invention provides a device as described above, wherein the sensor detects an acceleration of a part of the moveable part instead of a change in bend.

To further augment the reliability of a collision detection, it is advantageous to attach the sensor at the moveable part at an attachment location at which a high acceleration occurs in case of a collision. Such an attachment location is located i.a. in the region of a front edge and a rear edge of the table top.

Further, the invention presents a method for detecting the collision of an automatically moveable part of furniture by the following steps: operating an automatic driving mechanism by the controller for moving the moveable part in a predefined direction, detecting a change in bend of the moveable part at an attachment location by a sensor during a collision of the moveable part with an obstacle, transmitting a signal from the sensor to the controller, stopping the automatic driving mechanism by the controller. To cost efficiently execute such a method, a detection of the change in bend is carried out by changing an upsetting or a stretching of a piezoelectric material, e.g. in a piezoelectric diaphragm, during a change in bend of the attachment location at the moveable part, and generating of an electric signal by the piezoelectric material during the change in upsetting or stretching.

The invention provides a further method as described above, wherein a change in acceleration is detected instead of a change in bend of an attachment location of the moveable part by a sensor during a collision of the moveable part with an obstacle.

To further reduce damages by the collision or to stop a pinning state, it is advantageous, if the previous method is followed by the step of driving back the moveable part about a pre-defined distance in a direction opposing the original direction of movement.

In the following, referring to the figures, the invention is described by means of two embodiments and modifications thereof.

Figure 3A:
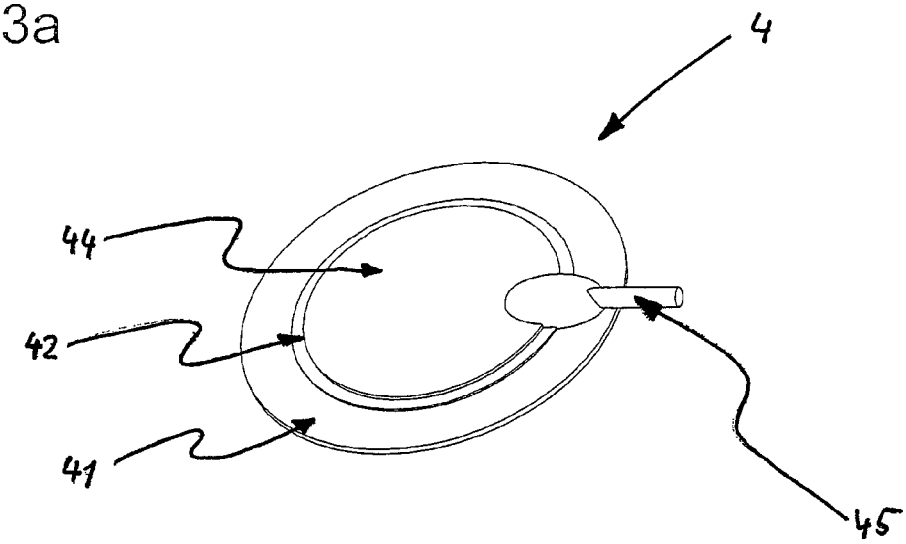

FIG. 3*a* shows a diagonal view of a piezoelectric diaphragm.

Figure 3B:
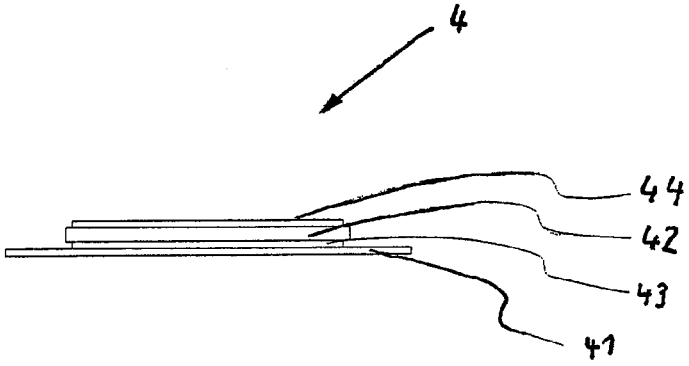

FIG. 3*b* shows a side view of a piezoelectric diaphragm.

Figure 3C:
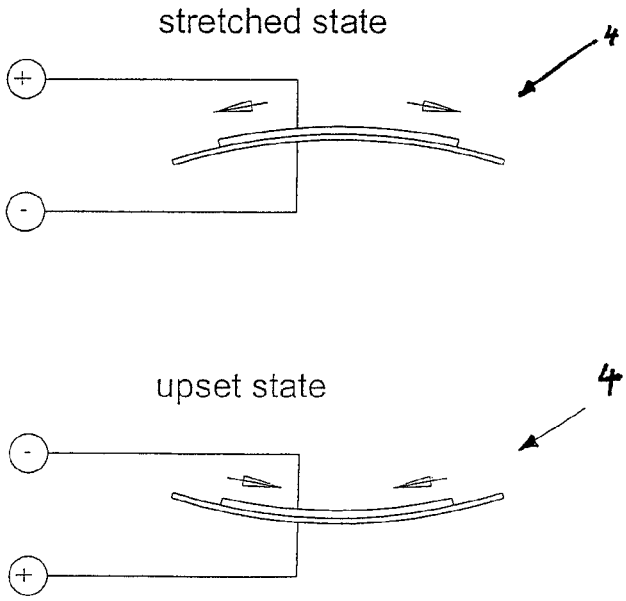

FIG. 3*c* shows side views of a piezoelectric diaphragm in a state bend upwardly and downwardly, respectively.

Figure 4A:
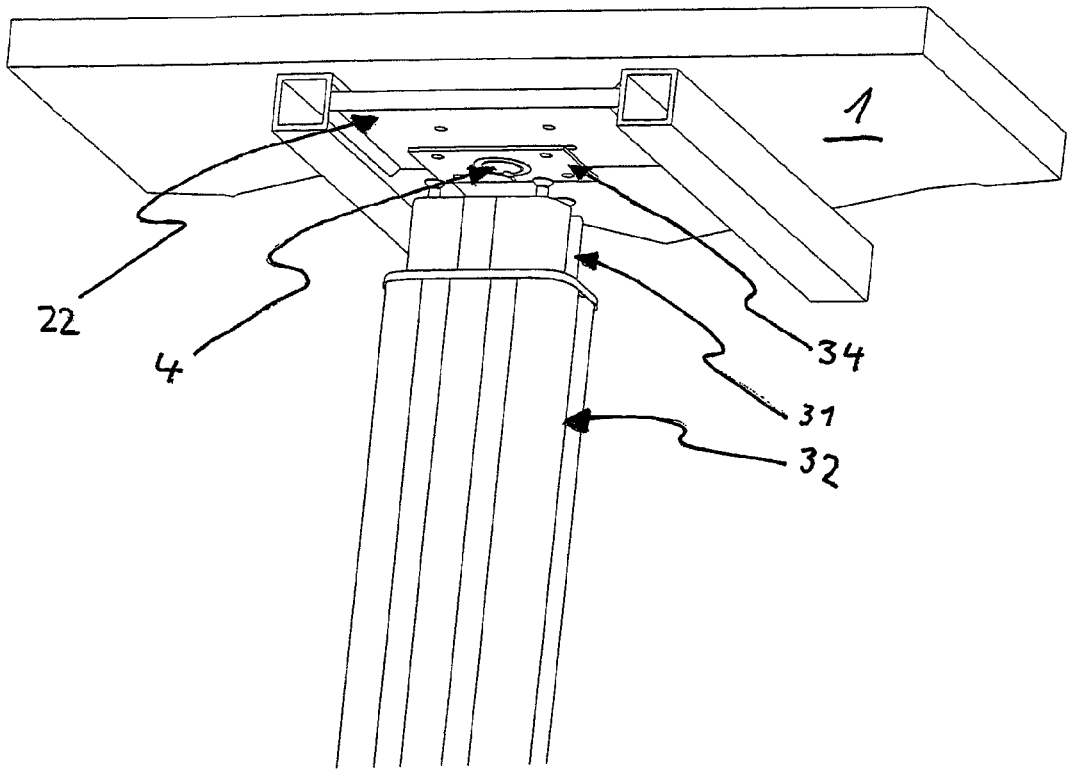

FIG. 4*a* shows a sectional view of the table with a sensor attachment location on an additional plate.

Figure 4B:
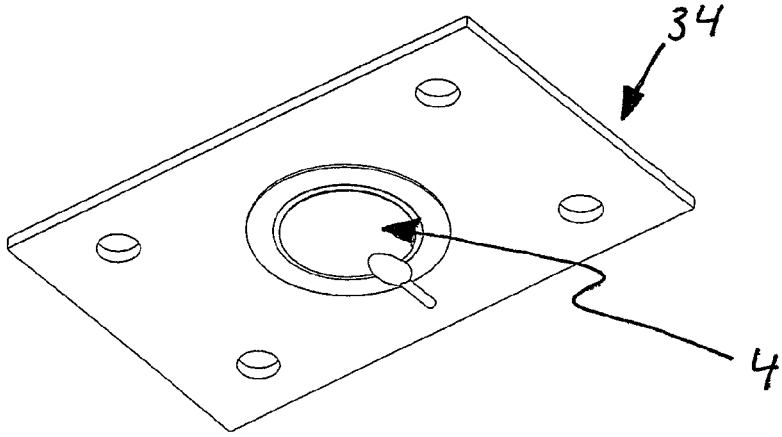

FIG. 4*b* shows an additional plate and a sensor attachment location of FIG. 4*a*.

Figure 5A:
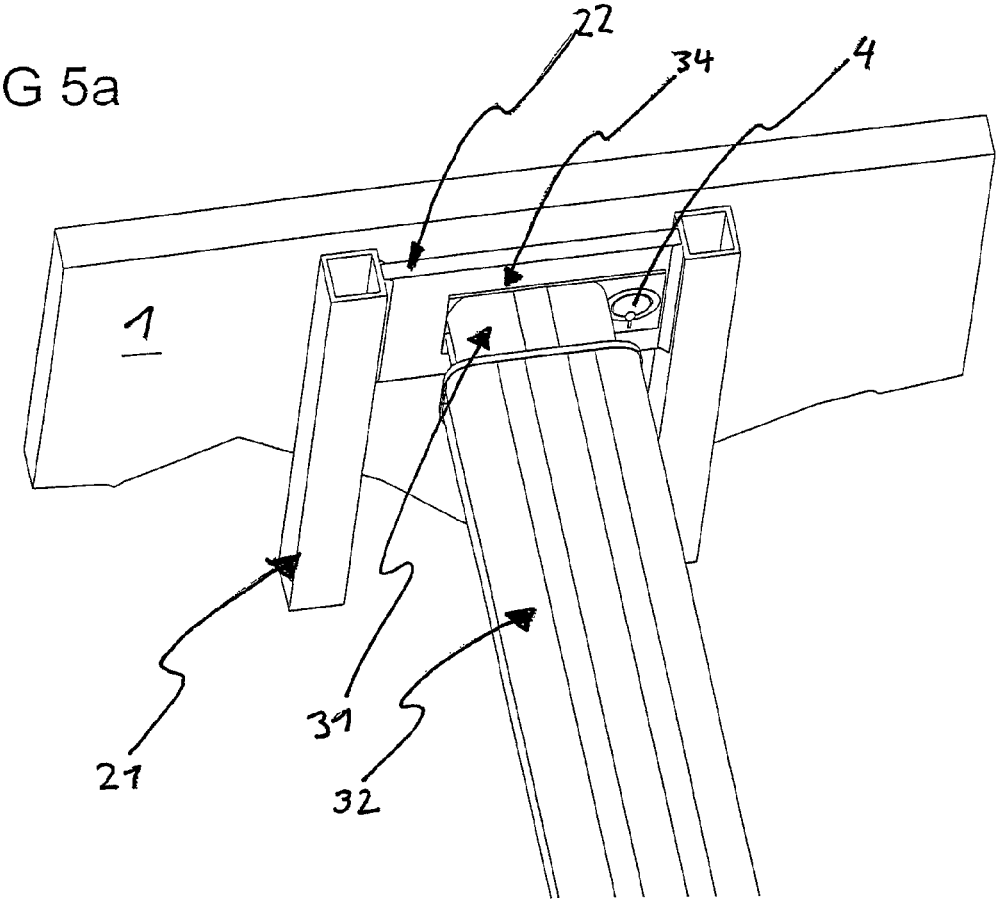

FIG. 5*a* shows a further sectional view with a sensor attachment location on an additional plate.

Figure 5B:
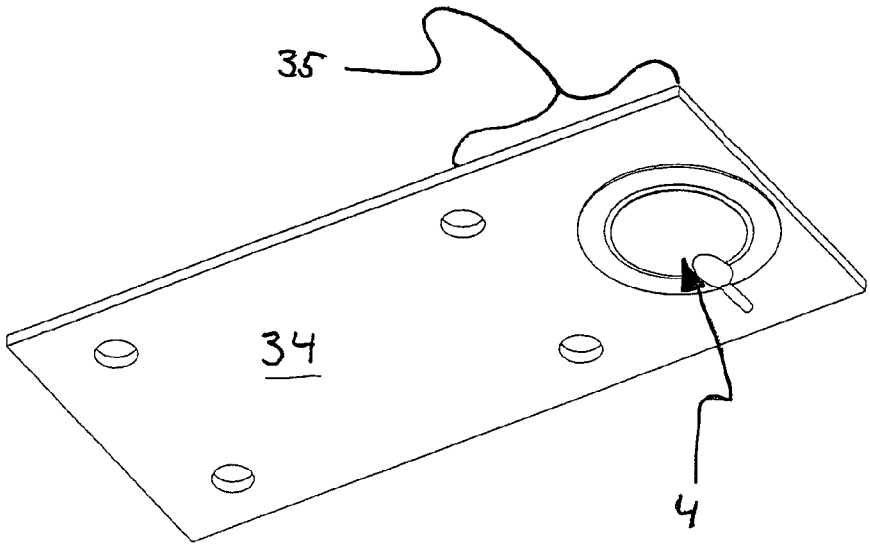

FIG. 5*b* shows the additional plate and the sensor attachment location of FIG. 5*a*.

Figure 6:
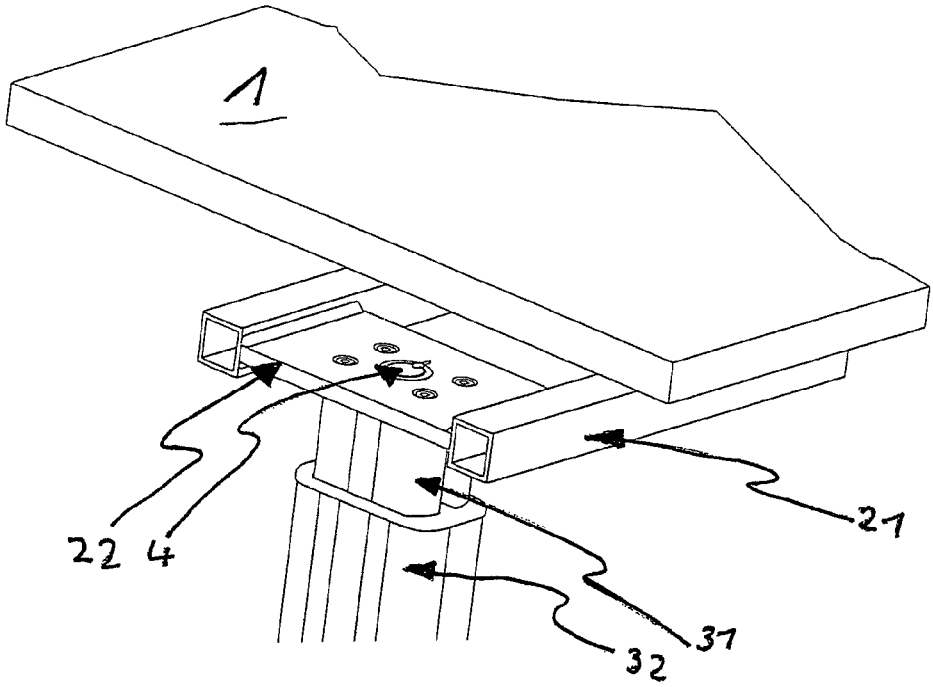

FIG. 6 shows a sectional view with a sensor attachment location on a supporting plate.

Figure 7:
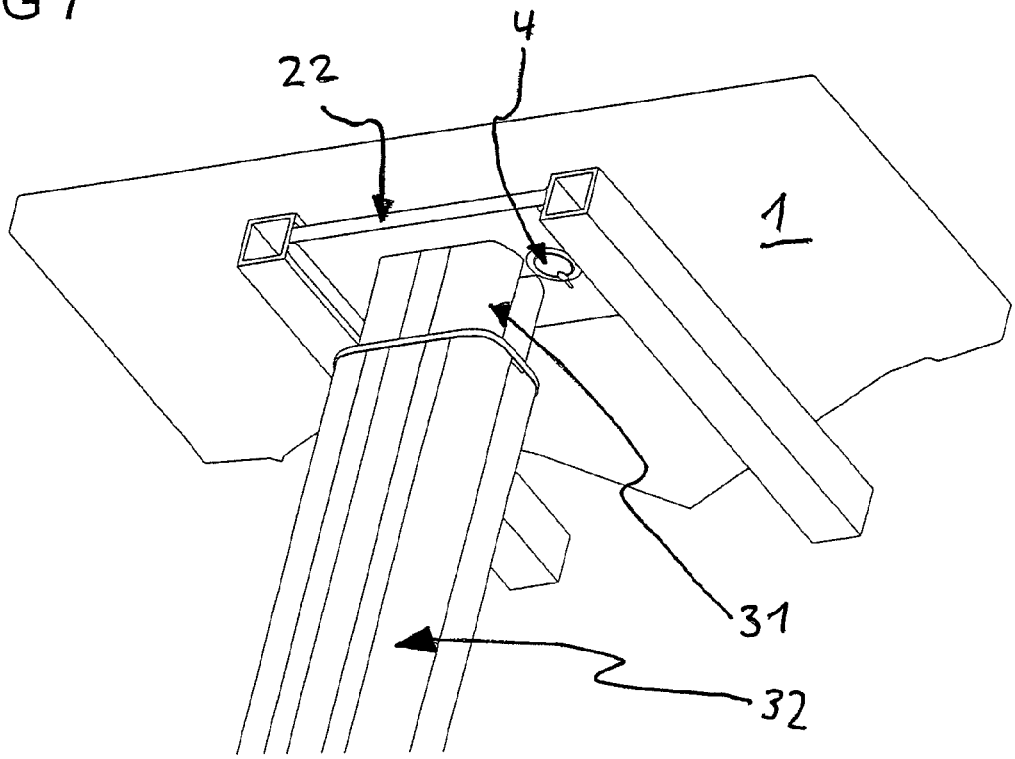

FIG. 7 shows a sectional view with another sensor attachment location on the supporting plate.

Figure 8:
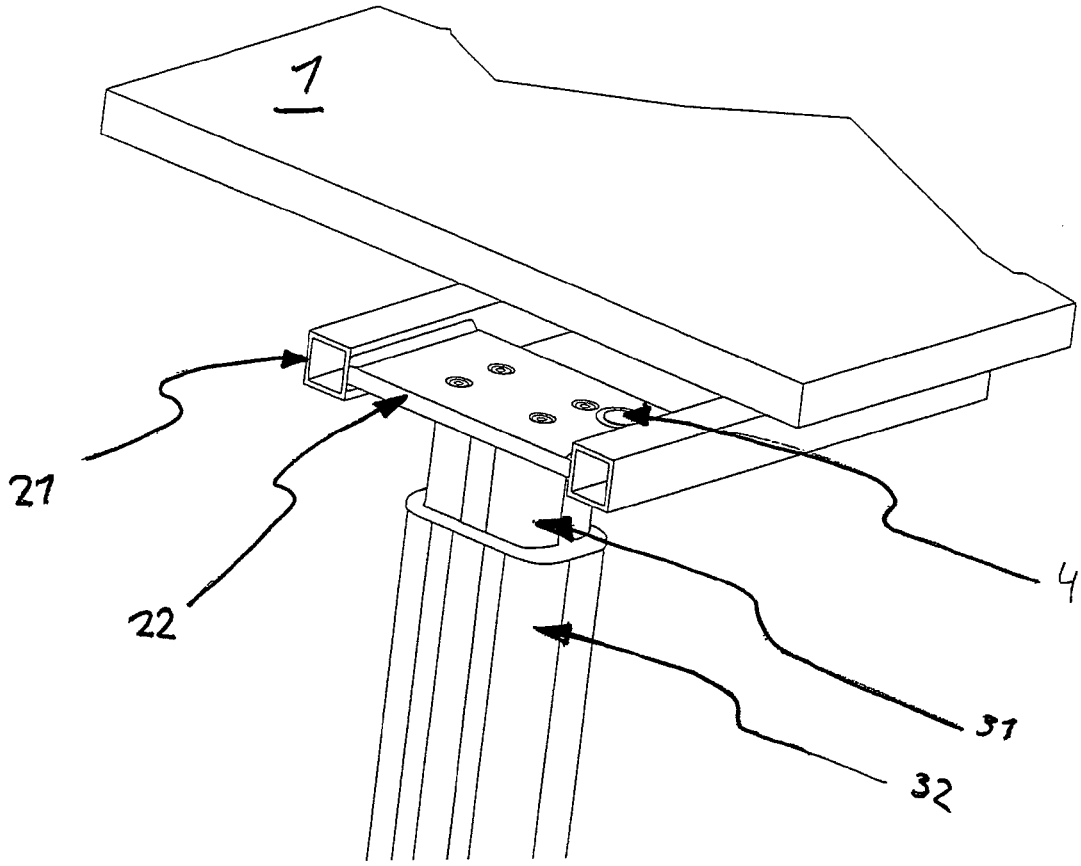

FIG. 8 shows a sectional view with another sensor attachment location on the supporting plate.

Figure 1:
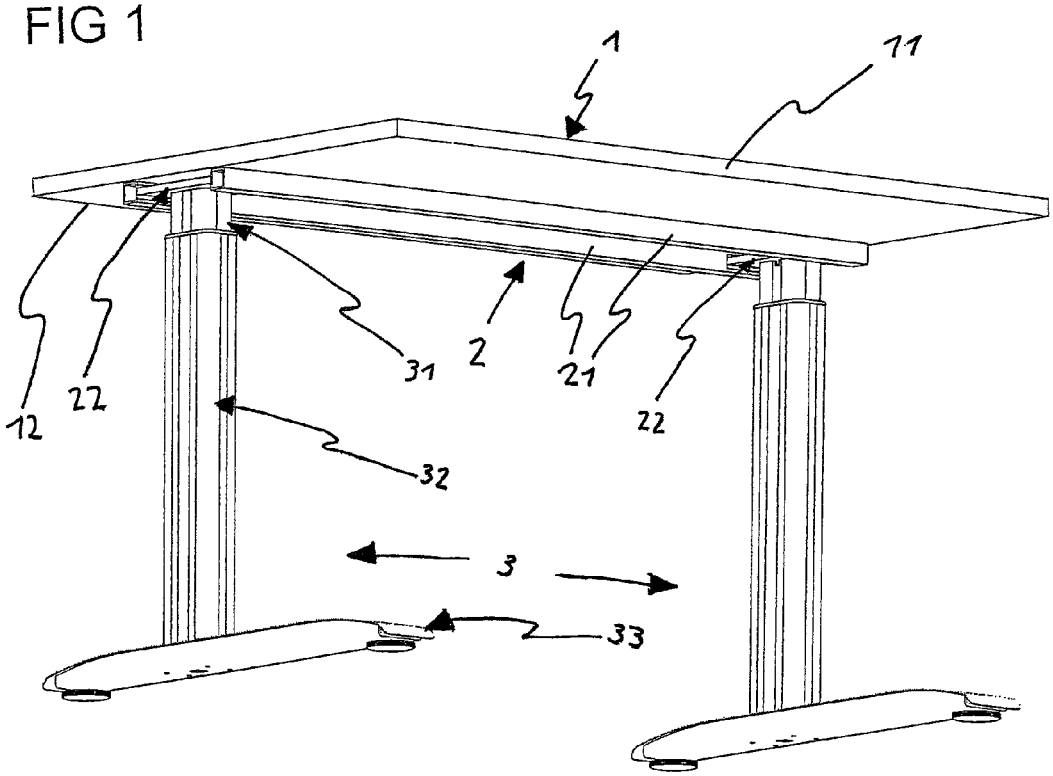
FIG. 1 shows a diagonal view of a table leg which is automatically adjustable in height.

FIG. 1 shows a table which is automatically adjustable in height, having a table top 1, comprising a front edge 11 and a rear edge 12. The table top 1 is fixed to a supporting frame 2 consisting of front and rear square brackets 21 and left and right supporting plates 22. The supporting plates 22 are connected to the table legs 3, respectively. A table leg consists of an inner table leg member 31 connected to the supporting plate 22 at its upper end and an outer table leg member 32, the table leg members being within each other such that the table leg 3 is adjustable in length in a telescopic manner. At the lower end of the outer member 32, a foot member 33 is arranged orthogonally thereto. Inside of the inner table leg member 31 and the outer table leg member 32, there are mounted a not shown electric motor and a not shown spindle gear with a threaded spindle. The electric motors of both table legs 3 are operated by a not shown controller and are adapted to rotate the threaded spindles and to, thus, carry out an automatic adjustment in length of the table legs 3. The controller is connected to switches, respectively, for selecting an upward movement and a downward movement of the table top.

Figure 2:
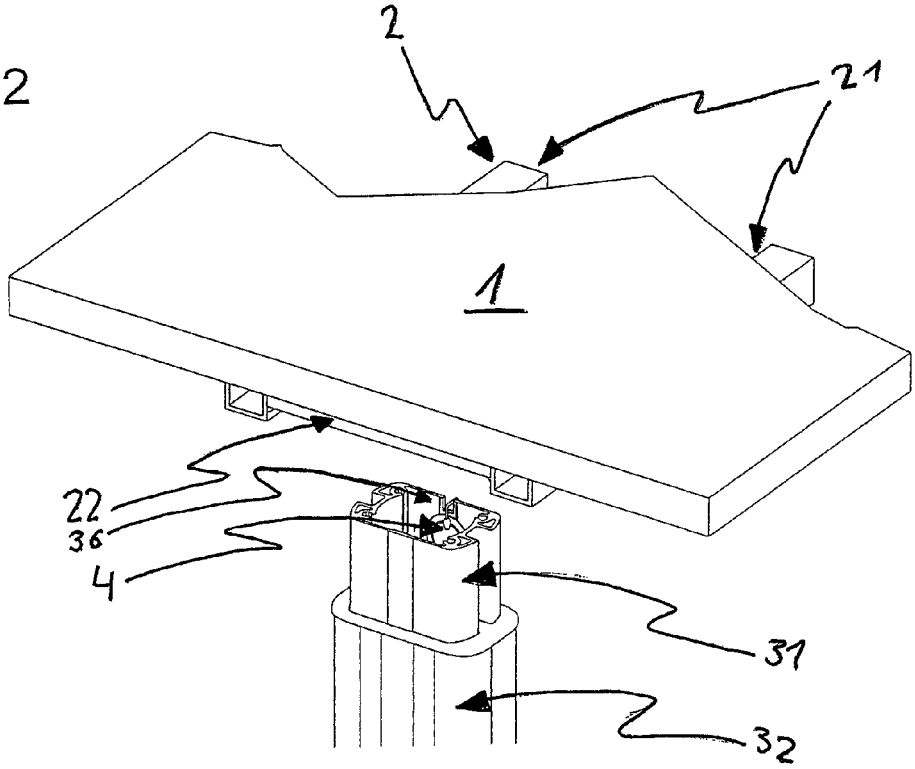
FIG. 2 shows a sectional view with a sensor attachment location within a table leg.

As shown in FIG. 2, a sensor 4 is located at the upper end of the hollow inner table leg member 31 at an inner side 36 in a radial direction, e.g. on an inner side facing the other table leg 3. As a sensor, a piezoelectric diaphragm 4 is used, conventionally used as cost efficient acoustic generator, for example in clocks, calculators and washing machines.

As shown in FIGS. 3*a* and 3*b*, in this embodiment, the piezoelectric diaphragm 4 consists of a circular discodial base plate 41 made of brass or special steel, on which a circular piezoelectric ceramic plate 42 is attached by agglutination. At the flat side of the piezoelectric ceramic plate 42 facing the base plate 41, an electrode 43 is arranged, and an electrode 44 is arranged at the opposing side of the piezoelectric ceramic plate 42.

It is basically valid that if a direct current is applied to both electrodes, a deformation of the piezoelectric ceramic plate 42 occurs. By using a laterally extending element for a piezoelectric ceramic plate 42, a deformation in a radial direction occurs. If this deformation is an extension, the piezoelectric diaphragm 4 bulges in a direction towards the side at which the piezoelectric plate is attached. An inversion of the applied voltage results in a bend in the opposing direction (see FIG. 3*c*).

In an inversed manner, if the bend of the piezoelectric diaphragm 4 is changed by action of an external force, the stretching of the piezoelectric ceramic plate 42 is increased or the upsetting of the piezoelectric ceramic plate is decreased, if the bend of the piezoelectric diaphragm 4 is changed towards the side, at which the piezoelectric ceramic plate 42 is attached. By the resulting deformation of the piezoelectric ceramic plate 42 in a radial direction, a difference in voltage is generated at the electrodes 43, 44 by the piezoelectric ceramic plate 42 during the deformation process. This difference in voltage is received over a wire 45, is transformed into a signal processible by the controller by a not shown external signal converter and is transmitted to the controller as a signal.

During an action of a force changing the bend of the piezoelectric diaphragm 4 in the opposite direction, a deformation of the piezoelectric diaphragm 4 occurs in an inverted direction, whereby an electric voltage with inverted polarity is generated at the electrodes 43, 44 during the deformation process.

In the following, the process of a collision detection is described. By an operator, a switch is operated signalling to the controller to perform e.g. a lowering of the table top. The controller now synchronously operates both electric motors of both table legs 3 in a rotational direction, by which a contraction of both table legs is performed by the threaded spindle, such that the inner table leg member 31 is retracted into the outer table leg member 32. Via the connection of the inner table leg member 31 with the table top 1 by the supporting frame 2, the table top is thereby lowered. If there is an obstacle below the table, e.g. in a central region of the front edge 11 of the table top, i.a. a slight bending of the table top 1 occurs, when the table top collides from above with the obstacle. This bending is transferred to the upper end of the table leg 3 by the supporting frame 2 and leads to a slight bending of the inner table leg member 31. The outer side of the bending of both inner table leg members 31 faces towards the opposing table leg 3, respectively. The piezoelectric diaphragm fixed to the attachment location shown in FIG. 3, is bend according to the bending of the table leg, the piezoelectric ceramic plate 42 is upset and a difference in voltage is generated at the electrodes 33 and 44. This difference in voltage is transmitted to the controller via the cable 45. The controller stops the rotation of both electric motors of the table legs 3, inverts the rotation and lifts the table top 1 upwardly by a pre-defined distance.

Alternatively to the attachment location shown in FIG. 2 at the radial inner side of the inner table leg member 31, the upper end of the inner table leg member 31 may be provided with an additional plate 34, on a lower side of which the attachment location of the piezoelectric diaphragm 4 is located, as shown in FIGS. 4*a* and 4*b*. At that side of the additional plate 34 of FIG. 4*b* which faces away from the person looking at the figure, a projection with a height of 0.2 mm is provided at a central location. This projection abuts to the supporting plate, when the table leg 3 and the supporting frame 2 are fixed to each other and causes that the additional plate is biased in a manner that it curves towards the table leg 3. In the case of a collision described above, a torque around the connecting axle of the respective fixing locations of the table legs 3 at the supporting frame 2 acts on the table top 1. Since the table legs 3 and the supporting frame 2 are connected to each other in a rotation invariant manner, a flexion of the supporting plate 22 occurs wherein the flexion is transmitted to the biased additional plate 34 and the piezoelectric diaphragm 4. The difference in electric voltage thus being generated by the deformation of the piezoelectric ceramic plate 42 is transmitted as outlined above to the controller as above.

Alternatively to the attachment locations at the radial inner side of the table leg member 31 shown in FIG. 4*a*, the additional plate 34 can be formed such that it overlaps the inner table leg member 31 at least one side with a section 35 by at least the width of the piezoelectric diaphragm 4, as shown in FIGS. 5*a* and 5*b*. Instead of providing the projection in the foregoing alternative, the overlapping section 35 of the additional plate 34 is slightly bent towards a side facing away from the person looking at FIG. 5*b*. When table leg 3 and supporting frame 2 are fixed to each other, the overlapping section 35 becomes biased. The attachment location of the piezoelectric diaphragm 4 is arranged at the biased overlapping section 35 outside of the table leg. This may be a accomplished, if the sizes of the inner table leg portion 31 do not permit an accommodation of the piezoelectric diaphragm at the additional plate 34 at the radial inner side of the inner table leg portion 31. Also, at this location, a bending deformation occurs in a case of a collision of the table top with an obstacle comparable to the one at the attachment location described in the foregoing paragraph.

An attachment of the sensor according to FIGS. 3, 4*a* and 5*a* additionally comprise the advantage, that sensors, controller and drive are concentrated in the table legs and further table members, like e.g. table top 1 and supporting frame 2, which are provided by third party manufacturers in many cases, stay unaffected.

Alternatively, the attachment location of the piezoelectric diaphragms 4 can be arranged on the supporting plate 22 of the supporting frame 2. Here, a high bending deformation is generated on a central position on the upper side of the supporting plate 22 shown in FIG. 6 or 7, at the position which is displaced towards the front edge 11 of the table top at the lower side or the upper side of the supporting plate, the bending deformation being reliably detected by the piezoelectric diaphragm 4.

In another embodiment according to the present invention, an acceleration sensor is used instead of a piezoelectric diaphragm 4. The acceleration sensor is a piezoelectric inertial sensor in which a predefined force is applied to a piezoelectric material by a rest mass. During a change in acceleration of the sensor, the rest mass's force applied to the piezoelectric material changes, whereby the upsetting or stretching thereof is changed. The remaining configuration of the embodiment corresponds to the configuration of the first embodiment to which reference is made. The attachment location of the acceleration sensor is located in the region of the front edge 11 and/or the rear edge 12 of the table top 1, since in a case of a collision of the table top with an obstacle, high acceleration values occur at these positions.

In the following, the process of a collision detection of the second embodiment is described. A movement initialization of the table top is initialized according to the collision detection process of the first embodiment. If the table top collides with an obstacle, e.g. in a central region of the front edge, the movement of the table top is slowed down, leading to an acceleration of the acceleration sensor attached to the table top in an upward direction. The acceleration sensor generates a difference in voltage, which is transmitted as a signal to the controller. The controller subsequently controls the drive of the electric motors in the manner described in the first embodiment.

The invention claimed is:

1. A device for recognizing collisions of automatically moveable parts of furniture with obstacles, comprising:

a piece of furniture with at least one moveable part, wherein this part is adapted to be moved relatively to the remaining piece of furniture in a non-manual manner, an automatic driving mechanism adapted to move the moveable part, a controller adapted to control the automatic driving mechanism, and a sensor adapted to detect a collision with an obstacle during the movement of the moveable part and to transmit the collision to the controller, wherein the sensor is adapted to detect a change in bend of the moveable part.

2. A device according to claim 1, wherein the sensor contains a piezoelectric material.

3. A device according to claim 2, wherein the sensor is a piezoelectric diaphragm.

4. A device according to claim 1, wherein the sensor is arranged at the moveable part at an attachment location, at which a higher than average bending moment is applied in a case of a collision.

5. A device according to claim 4, wherein the sensor is attached at the moveable part at an attachment location, at which a higher than average deflection is applied instead of the bending moment during a case of a collision.

6. A device according to claim 4, wherein the piece of furniture is a table adjustable in height, the table including at least one table leg adjustable in height, and the attachment location is arranged at the upper end region thereof.

7. A device according to claim 4, wherein the piece of furniture is a table adjustable in height, comprising at least one table leg adjustable in height, the table leg being hollow, and the attachment location is arranged at an inner side seen in a radial direction.

8. A device according to claim 4, wherein the piece of furniture is a table adjustable in height, comprising at least one table leg adjustable in height, at the upper end of which an additional plate is provided, and the attachment location is arranged on the additional plate.

9. A device according to claim 8, wherein the additional plate exceeds the perimeter of the table leg and the attachment location is arranged outside the outer perimeter of the upper end of the table leg.

10. A device according to claim 4, wherein the piece of furniture is a table adjustable in height, comprising at least one table leg adjustable in height and a table top being directly or indirectly connected to the table leg, and the attachment location is arranged at the table top in close proximity to the upper end region of the table leg.

11. A device according to claim 4, wherein the piece of furniture is a table adjustable in height, comprising at least one table leg adjustable in height and a table top, the table top is connected to a supporting frame comprising a horizontal supporting plate connected to the table leg, and the attachment location is arranged at the table top opposite to the upper end region of the table leg.

12. A device according to claim 11, wherein the attachment location is arranged at the supporting plate neighbouring the upper end region of the table leg or opposite to this attachment location at the other side of the supporting plate.

13. A device according to claim 1, wherein the sensor is adapted to detect an acceleration of a portion of the moveable part instead of a change in bend of the moveable part.

14. A device according to claim 13, wherein the sensor is arranged at the moveable part at an attachment location, at which a higher than average acceleration is applied in a case of a collision.

15. A device according to claim 14, wherein the piece of furniture is a table adjustable in height, comprising at least one table leg adjustable in height and a table top with a front edge and a rear edge, and the attachment location is arranged at the front edge or the rear edge.

16. A method for recognizing/handling collisions with automatically moveable parts of furniture with obstacles comprising the steps:

a) providing a piece of furniture that includes:

i) at least one moveable part that is adapted to be moved relatively to the remaining piece of furniture in a non-manual manner, ii) an automatic driving mechanism adapted to move the moveable part, iii) a controller adapted to control the automatic driving mechanism, and iv) a sensor adapted to detect a collision with an obstacle during the movement of the moveable part and to transmit the collision to the controller, b) driving an automatic driving mechanism by the controller for moving the moveable part in a pre-defined direction, c) detecting a change in bend or a change in acceleration of an attachment location of the moveable part by a sensor during a collision of the moveable part with an obstacle, d) transmitting a signal from the sensor to the controller, and e) stopping the automatic driving mechanism by the controller.

17. A method according to claim 16 wherein step c) consists of:

$c_1$) changing an upsetting or stretching of a piezoelectric material during the change in bend of the attachment location of the moveable part, and $c_2$) generating an electric signal by the piezoelectric material during the change in upsetting or stretching.

18. A method according claim 17, wherein step $c_2$) consists of:

changing the bend of a piezoelectric diaphragm.

19. A method according to claim 16, wherein the detection of the change in bend is carried out at an attachment location comprising a higher than average bending strain during a collision.

20. A method according to claim 16, wherein the steps follow the step of moving back the moveable part by a predefined distance in a. direction opposing the previous moving direction.

* * * * *